United States Patent [19]

Chaverebiere de Sal et al.

[11] 3,987,745

[45] Oct. 26, 1976

[54] SYSTEM FOR THE EXPLORATION AND INSPECTION OF SEA BEDS BY MEANS OF A VESSEL HAVING AN EXTERNAL POWER SUPPLY SYSTEM

[75] Inventors: Alain Chaverebiere de Sal, Paris; René Victor Donnart, Saint-Tropez; Michel Jean Paul Darche, Ville d'Avray, all of France

[73] Assignee: Societe ECA, Asnieres, France

[22] Filed: Apr. 7, 1975

[21] Appl. No.: 565,840

[30] Foreign Application Priority Data

May 8, 1974 France ..... 74.15843

[52] U.S. Cl. ..... 114/235 B; 340/3 T

[51] Int. Cl.[2] ..... B63B 21/26

[58] Field of Search ..... 114/235 B, 16 R; 340/3 T; 354/64

[56] References Cited

UNITED STATES PATENTS

| | | | |
|---|---|---|---|
| 3,105,453 | 10/1963 | Hayes | 114/235 B |
| 3,434,446 | 3/1969 | Cole | 114/235 B |
| 3,780,220 | 12/1973 | Fugitt et al. | 354/64 |
| 3,880,103 | 4/1975 | Talkington | 114/16 R |

FOREIGN PATENTS OR APPLICATIONS

| | | | |
|---|---|---|---|
| 942,490 | 5/1956 | Germany | 114/235 B |

*Primary Examiner*—Trygve M. Blix
*Assistant Examiner*—Jesus D. Sotelo

[57] ABSTRACT

The invention relates to a system comprising at the end of a first support and towing cable a first underwater vessel which may or may not be automatically stabilized in altitude relative to the sea bed, whereby from the said first vessel passes a second cable towed by a second stabilized self-propelling underwater vessel which is remotely controlled and carries detection instruments, whereby the first cable is a towing cable and whereby these two cables transmit power generated on the surface craft, remote control signals from the second vessel and detection signals from the second vessel.

6 Claims, 3 Drawing Figures

Fig. 1.
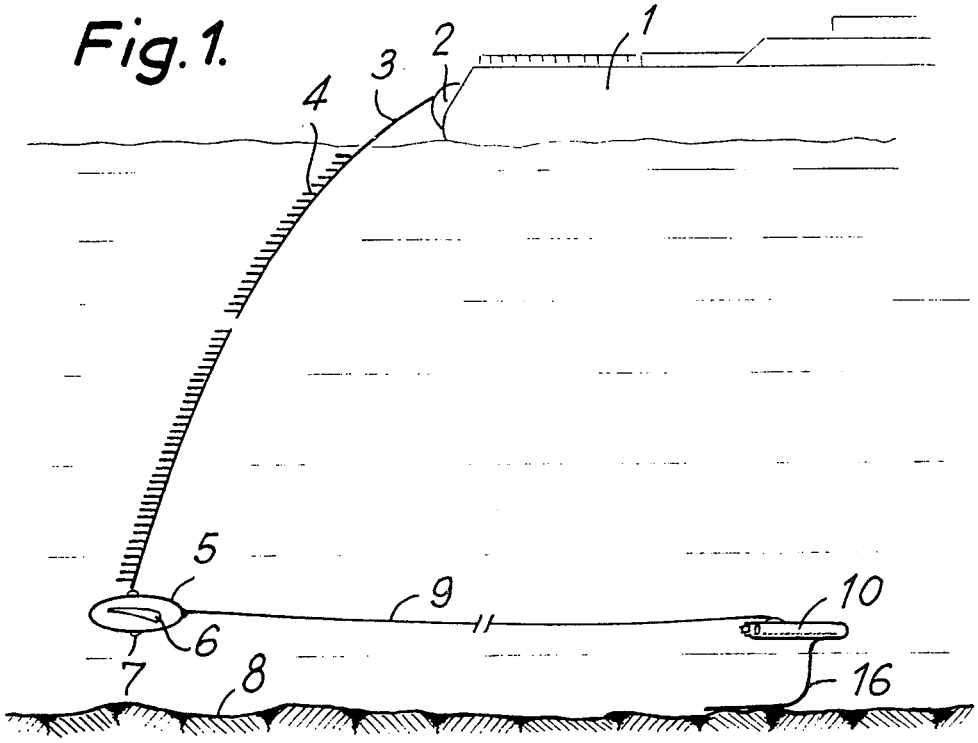
Fig. 2.
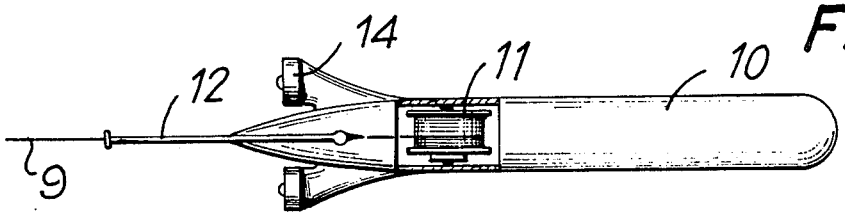
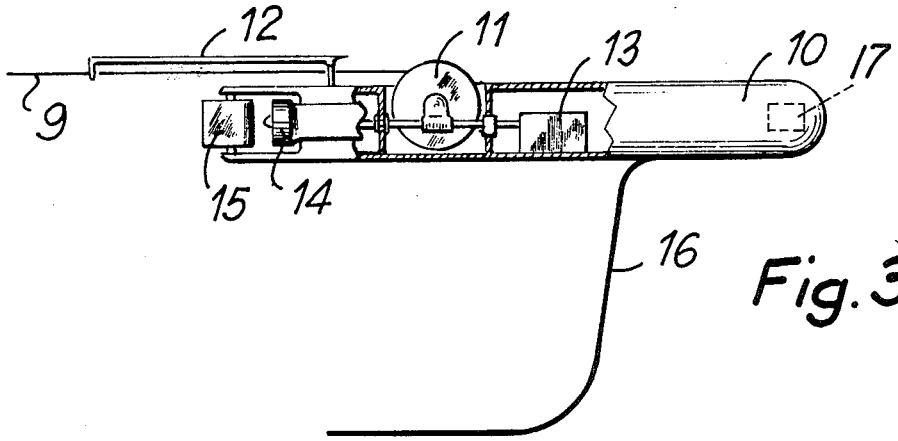
Fig. 3.

SYSTEM FOR THE EXPLORATION AND INSPECTION OF SEA BEDS BY MEANS OF A VESSEL HAVING AN EXTERNAL POWER SUPPLY SYSTEM

The present invention relates to underwater vessels.

Fusiform-shaped vessels, generally called midget submarines are already known which are able to perform various underwater missions.

These vessels can be sub-divided into two main classes, those which are towed and those which are autonomous.

Autonomous vessels of this type are equipped with engines and controls which can give them a high degree of manoeuvrability. However, the energy sources which can be used in the absence of ambient air such as sets of storage cells, compressed air tanks or the like only permit a very limited operation which generally does not exceed a few hours.

Autonomous vessels of this type can be guided more particularly by indirect remote control by means of a cable. This is an electric cable of small cross-section which is freely unwound at the rear of the vessel so that it does not brake the same. The vessel performs observations and detects its position relative to space, the sea bed or a random object by means of appropriate sensors and transmits this information by the cable to a human operator in a ship or on land. The operator transmits his orders by the same cable and controls the manoeuvres and operations of the vessel. The limited capacity of the cable drum restricts the manoeuvrability and operating period of the vessel. The altitude guidance of an autonomous vessel can be performed by the general means indicated hereinbefore or more directly in certain cases by a trail rope dragging on the sea bed.

Vessels which are towed by a surface craft or by a submarine draw out their towing cable with a large variation in altitude between the two ends of the said cable by means of their negative or positive buoyancy and their upwardly or downwardly directed hydrodynamic lift, according to the case in question. This lift is obtained by one or a plurality of wings or fins and can be regulated by deflecting the said wings or fins or by the action of depth control means. The necessary lift and buoyancy forces can be reduced if the cable is profiled with strips, projections or the like.

Unlike in the case of autonomous vessels, the manoeuvrability of towed vessels is very small. In the horizontal plane, they are forced to follow the movements of the towing craft. It is only possible to vary the vertical distance between the vessel and the towing craft by action on the fins or the control means of the vessel and/or by action on a winch installed aboard the craft and about which is wound the towing cable.

However, a towed vessel can operate for an almost unlimited period and in practice only depends on the life of the cable which can be as long as several months.

The altitude guidance of a towed vessel can be brought about either by remote control or automatically with detection by a sensor as indicated hereinbefore in the case of the autonomous vessel, the optional transmission of information and orders via the towing cable and action on the fins or control means or on the winch. A trail rope cannot be used unless it serves merely as an altitude detector.

The object of the present invention is to combine the advantages of the two above-mentioned types of underwater vessel, namely the manoeuvrability of the one and the prolonged duration of operation of the other. It can be applied more particularly for missions involving the inspection and exploration of objects such as lines, cables or pipes laid on the sea bed.

To this end, the invention comprises a system involving the use of a towed vessel such as described hereinbefore and an autonomous vessel such as described hereinbefore.

In addition to the two above-mentioned underwater vessels, the invention comprises the following features.

A surface craft is equipped with a winch, an electricity supply system, a control console and other devices for operating the two vessels.

Close to the sea bed, this craft tows a first underwater vessel whose function is to draw the towing cable downwards due to its own weight, its negative hydrodynamic lift or a combination of both of these.

This first vessel is linked by a long cable with a second vessel which also moves close to the sea bed but can be displaced in a horizontal plane via one or more engines and optionally steering equipment. As these two vessels are submerged to substantially the same degree, the cable linking them is subjected to only slight hydrodynamic forces. It is only slightly reinforced and its diameter is small. It contains the electrical conductors necessary for the power supply and the control of the second vessel. The same conductors, optionally via an electrical connector on the first vessel, traverse the towing cable which is reinforced and has a large diameter, thereby permitting the operation of the second vessel.

A following description of non-limitative embodiments of the invention with reference to the attached drawings provides a better understanding of the invention. In the drawings show:

FIG. 1 a diagram illustrating the towing of two submerged vessels by a surface craft.

FIG. 2 a schematic plan view on a larger scale of a second underwater vessel.

FIG. 3 a profile with cutaway portions.

As shown in FIG. 1, the inspection system comprises on the surface a craft 1 having a winch 2 which can supply a towing cable 3 which transmits electrical energy supplied by a generating plant in the surface craft and transmission and reception signals supplied by transmitters and fed to receivers, which will be described hereinafter. This complex cable of large cross-section is provided with anti-eddy fringes 4 facilitating the penetration thereof into the water and preventing vibrations thereto.

Cable 3 is drawn downwards by a first vessel 5 having negative buoyancy which is optionally provided with depth control means 6 whose deflection can be determined by the signals from a vertical sonar 7 so that the said first vessel 5 will have a substantially constant altitude above the sea bed 8 to be explored and observed.

A second substantially horizontal cable 9 is fixed to the head of the first vessel 5, whereby to the said cable is attached a steerable, detecting, self-propelling vessel 10. This second cable 9 transmits electrical power, remote control and detection signals. The transmission of electricity by the second cable 9, connected by its active elements to those of the first cable 3 therefore ensures the power supply to the second vessel 10 directly from the craft 1, the transmission of control commands from craft 1 to vessel 10 and the transmission of detection signals from the detectors in the second vessel 10 to the observation instruments in craft 1.

Therefore, the second cable 9 can have a smaller size because it does not have to withstand the towing forces of cable 3 and can be attached to the second vessel 10, by a motorized winch 11 carried by the second vessel 10. Upstream of winch 11, cable 9 passes via the rings of a pole 12 articulated to the second vessel, whose angles relative to the axes of the second vessel are recorded by two potentiometers carried by the second vessel 10 and whereof the slides are fixed to the universal joints of pole 12.

In the second vessel 10 are provided engines (such as 13) for operating the optional winch 11, two independent lateral screw propellers 14 and a direction or depth control means. In the head of the second vessel are provided electrical projectors such as a television camera which scans the sea bed 8, as well as an internal compass schematically shown at 17.

The altitude of the second vessel can be stabilized relative to the sea bed 8 through having a slightly positive buoyancy and by carrying a releasable trail rope 16 or by any other appropriate means.

Obviously, the second vessel 10 is provided with a system for distributing electrical power to its accessories, projectors, camera, screw propellers, winch and control means which permit, by receiving remote control signals from vessel 1 via the cables, the transverse piloting of the second vessel 10 well beyond the towing trajectory, dependent on the drag of the second cable as well as the length of the latter which is invariable or regulatable if there is a winch 11.

The position relative to the craft is established by reading data obtained through interpreting those supplied by the angles of pole 12 and the compass, fed to the craft as video signals from the camera via the corresponding transmission members of cables 3 and 9.

The inspection and exploration of the sea bed 8 is ensured in one of the two following ways.

If the second vessel does not have a winch 11, it is submerged first. It is supplied with power and controlled in such a way that it draws cable 9 forwards during the descent. Then, the first vessel 5 is submerged at the end of cable 3 supplied by winch 2 and the two vessels descend together.

If the second vessel has a winch, the two vessels can be submerged simultaneously and when they have reached the desired depths, the second vessel which moves forward on winding its cable is supplied with electric power and piloted. The altitude and orientation of the second vessel 10 are optionally controlled by the trail rope 16 and the clearance of its two screw propellers and its steering system 15.

The sea bed and more particularly a submarine pipeline or cable is explored firstly by controlled manoeuvres of the second vessel and vision of the sea bed on board craft 1. Once the submarine object has been found and its condition has been monitored, it can be completely examined during the movement of the second vessel whose angular readings, course followed on the compass, attachment angles to the connecting cable 9 can be interpreted on board craft 1 in order to ensure the piloting thereof, which tends to bring the whole system in a single vertical plane for cables and vessels. The environment can also be monitored by systematic sweeps or performed at specific points on request through interlinked manoeuvres of the winch and screw propellers.

At the end of the mission, it is merely necessary to cut the trail rope in order to give the second vessel its inherent positive buoyancy so that it will freely return to the surface. This remotely controlled cutting can act on a single or double pyrotechnic shears or any other appropriate means, depending on the trail rope attachment method. The connecting cable 9 can also be cut, should this prove necessary, relative to one of the two vessels. A first vessel is raised by winch 2 and main cable 3, whilst the second vessel can be the object of a separate recovery operation.

Thus, there is no limit to the manoeuvrability and length of mission relative to the second vessel as was the case with autonomous vessels of this type supplied in known manner by energy sources such as storage cells on board the surface craft. The power available to the various engines and projectors is no longer subject to the same limitations so that the efficiency of the missions is greatly increased.

Various modifications can obviously be made to the above-described embodiments without passing beyond the scope of the present invention.

We claim:

1. A system for the exploration and inspection of a sea bed comprising a surface craft, a first underwater non-buoyant vessel, means for automatically stabilizing the altitude of said first underwater vessel at a predetermined level relative to the sea bed, a first cable connecting said first underwater vessel to said surface craft for towing the same, and means for maintaining said first cable taut to support said first underwater vessel, a second remotely controlled self-propelling vessel having means for stabilization at the level of said first vessel and detection instruments housed therein for scanning of the sea bed a second cable connecting said first and second underwater vessel, means for maintaining the axes of said first and second underwater vessel substantially colinearly aligned with respect to said second cable and means for transmitting energy generated on the surface craft, remote control signals from the second vessel, and detection signals from the latter to and from said surface craft and said second vessel via said first and second cables.

2. The apparatus according to claim 1, wherein said means for stabilizing said second underwater vessel at the level of said first underwater vessel comprises an elongated drag line extending therefrom into contact with the sea bed.

3. The apparatus according to claim 1, wherein said second cable is wound onto a remotely controlled winch carried by the second vessel.

4. The apparatus according to claim 1, wherein the first vessel included sonar and depth control means for dynamically stabilizing said first vessel with negative buoyancy.

5. The apparatus according to claim 1, wherein the second vessel includes means for detecting the angle between the second cable direction and the axis of said second underwater vessel.

6. The apparatus according to claim 1, wherein the said second vessel is equipped with projectors and at least one television camera and a compass the indication of which being visually transmitted from one of said cameras to said surface vessel.

* * * * *